US009466238B2

(12) United States Patent
Seo et al.

(10) Patent No.: US 9,466,238 B2
(45) Date of Patent: Oct. 11, 2016

(54) DISPLAY DEVICE AND DRIVING METHOD THEREOF

(71) Applicant: SAMSUNG DISPLAY CO., LTD., Yongin, Gyeonggi-do (KR)

(72) Inventors: Hee-Jeong Seo, Asan-Si (KR); Jang-Hoon Kwak, Cheonan-Si (KR); Eun-Kyung Kim, Asan-Si (KR); Jae Hyoung Park, Suwon-Si (KR); Jong-Young Yun, Gwangmyeong-Si (KR); Jun Pyo Lee, Asan-Si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 238 days.

(21) Appl. No.: 14/170,882

(22) Filed: Feb. 3, 2014

(65) Prior Publication Data

US 2015/0054801 A1 Feb. 26, 2015

(30) Foreign Application Priority Data

Aug. 22, 2013 (KR) ..... 10-2013-0099934

(51) Int. Cl.
*G09G 5/00* (2006.01)
*G09G 3/20* (2006.01)
*G09G 3/22* (2006.01)

(52) U.S. Cl.
CPC ..... *G09G 3/2085* (2013.01); *G09G 3/2096* (2013.01); *G09G 3/22* (2013.01); *G09G 2310/0267* (2013.01); *G09G 2310/0275* (2013.01); *G09G 2310/0278* (2013.01)

(58) Field of Classification Search
CPC ..... G09G 3/2085; G09G 5/18; G09G 3/22
USPC ..... 345/204–205; 439/55–85
See application file for complete search history.

(56) References Cited

U.S. PATENT DOCUMENTS 7,342,634 B2 * 3/2008 Park ..... G02F 1/13452 345/100
8,289,258 B2 10/2012 Song et al.
2004/0150581 A1 8/2004 Westerinen et al.

(Continued)

FOREIGN PATENT DOCUMENTS

JP 2006-032155 2/2006
JP 2008-304363 12/2008

(Continued)

*Primary Examiner* — Kent Chang
*Assistant Examiner* — Scott Au
(74) *Attorney, Agent, or Firm* — F. Chau & Associates, LLC

(57) ABSTRACT

A display device includes: a control board on which a timing controller (TCON) and a power management integrated circuit (PMIC) are installed; a first source board on which a driving integrated circuit (IC) is installed; and a first connection cable that connects the control board and the first source board. The control board includes a first sensing line that connects the PMIC to the first connection cable and a third feedback line that connects the first connection cable to the TCON, the first connection cable includes a second sensing line that connects the first sensing line to the first source board and a second feedback line that connects the third feedback line to the first source board, and the first source board includes a third sensing line connected to the second sensing line and a first feedback line connected to the second feedback line.

19 Claims, 10 Drawing Sheets

(56) References Cited

U.S. PATENT DOCUMENTS

| | | | | |
|---|---|---|---|---|
| 2011/0021052 | A1 | 1/2011 | Hirata et al. | |
| 2012/0056864 | A1* | 3/2012 | Aioanei | G09G 3/3696 345/212 |

FOREIGN PATENT DOCUMENTS

| | | |
|---|---|---|
| JP | 4837631 | 10/2011 |
| KR | 10-2007-0072138 | 7/2007 |

* cited by examiner

DISPLAY DEVICE AND DRIVING METHOD THEREOF

CROSS-REFERENCE TO RELATED APPLICATION

This application claims priority under 35 U.S.C. §119 from Korean Patent Application No. 10-2013-0099934 filed in the Korean Intellectual Property Office on Aug. 22, 2013, all the benefits accruing therefrom, the contents of which are herein incorporated by reference in their entirety.

BACKGROUND (a) Field

Embodiments of the present disclosure are directed to a display device and a driving method thereof, and more particularly, to a display device and a driving method thereof capable of preventing a failure due to disconnection and misinsertion of a control board and a source board.

(b) Description of the Related Art

A display device includes a plurality of scan lines connected to a plurality of pixels, and a plurality of data lines connected to the plurality of pixels. The plurality of pixels is formed at cross points of the scan lines and the data lines.

Gate-on voltage scanning signals are sequentially applied to the plurality of scan lines, and data signals are applied to the plurality of data lines in response to the gate-on voltage scanning signals, and as a result, image data are written to the plurality of pixels.

Recently, a large-sized high resolution 3840×2160 pixel display device having a size of 80 inches or more has been produced. As this display device has higher resolution and a larger size, a load applied to a driving integrated circuit (IC) that outputs a data signal increases. When the load is increased beyond a limit, the driving IC may overheat and break down.

One method of reducing the load on the driving IC distributes the load by connecting the driving ICs to both ends of the data line. However, when the display device is driven while any one of the driving ICs of both ends of the data line is disconnected or misconnected, the load is concentrated in the other driving IC. This may cause a failure of the driving IC and a power circuit or a control circuit connected to the driving IC.

Further, in a full HD 1920×1080 pixel display device, or a display device having resolution of 1920×1080 or less, when the driving IC is misconnected, a short between a power pin and another adjacent pin may be generated, which may cause a failure of the driving IC and the power circuit or the control circuit. For example, when a short between the power of the driving IC and a ground is generated or a short between an output of the driving IC and the power of a gate IC is generated, the driving IC and the gate IC may break down.

SUMMARY

Embodiments of the present disclosure provide a display device that may prevent a failure due to disconnection and misinsertion of a control board and a source board.

An exemplary embodiment of the present disclosure provides a display device that includes: a control board on which a timing controller (TCON) and a power management integrated circuit (PMIC) are installed; a first source board on which a driving integrated circuit (IC) is installed; and a first connection cable that connects the control board and the first source board. The control board includes a first sensing line that connects the PMIC to the first connection cable, and a third feedback line that connects the first connection cable to the TCON. The first connection cable includes a second sensing line that connects the first sensing line to the first source board, and a second feedback line that connects the third feedback line to the first source board. The first source board includes a third sensing line connected to the second sensing line, and a first feedback line connected to the second feedback line.

The PMIC may output a sensing signal to the first sensing line, and the TCON may determine a connection state of the control board and the first source board from a signal received from the third feedback line.

The TCON may transmit am on-voltage power enable signal to the PMIC if the signal received from the third feedback line is at a predetermined voltage.

The TCON may transmit an off-voltage power enable signal to the PMIC if the signal received by the third feedback line is not at a predetermined voltage.

The PMIC may stop driving when the off-voltage power enable signal is received.

The display device may further include a second connection cable that connects the control board to the first source board, and includes a fourth sensing line that connects the third sensing line to the control board. The control board may include a fifth sensing line connected to the fourth sensing line, the second connection cable may include a sixth sensing line that connects the fifth sensing line to the first source board, and the first source board may include a seventh sensing line connected to the sixth sensing line.

A bead may be installed on the first source board that connects the seventh sensing line to the first feedback line.

The display device may further include a third connection cable connected to the control board; a fourth connection cable connected to the control board; and a second source board connected to the control board through the third connection cable and the fourth connection cable.

The third connection cable may be configured the same as the first connection cable, the fourth connection cable may be configured the same as the second connection cable, and the second source board may be configured the same as the first source board.

The display device may further include a first source board cable connected to the first source board; and a second source board connected to the first source board through the first source board cable. The first source board cable may include an eighth sensing line that connects the seventh sensing line to the second source board, the second source board may include a ninth sensing line connected to the eighth sensing line and a fourth feedback line connected to the ninth sensing line, and the first source board cable may include a fifth feedback line that connects the fourth feedback line to the first feedback line.

The display device may further include a third connection cable connected to the control board; a fourth connection cable connected to the control board; a third source board connected to the control board through the third connection cable and the fourth connection cable; a second source board cable connected to the third source board; and a fourth source board connected to the third source board through the second source board cable.

The third connection cable may be configured the same as the first connection cable, the fourth connection cable may be configured the same as the second connection cable, the third source board may be configured the same as the first source board, the fourth source board may be configured the same as the second source board, and the second source board cable may be configured the same as the first source board cable.

The display device may further include a fifth connection cable connected to the control board; a sixth connection cable connected to the control board; a fifth source board connected to the control board through the fifth connection cable and the sixth connection cable; a third source board cable connected to the fifth source board; and a sixth source board connected to the fifth source board through the third source board cable.

The fifth connection cable may be configured the same as the first connection cable, the sixth connection cable may be configured the same as the second connection cable, the fifth source board may be configured the same as the first source board, the sixth source board may be configured the same as the second source board, and the third source board cable may be configured the same as the first source board cable.

The display device may further include a seventh connection cable connected to the control board; an eighth connection cable connected to the control board; a seventh source board connected to the control board through the seventh connection cable and the eighth connection cable; a fourth source board cable connected to the seventh source board; and an eighth source board connected to the seventh source board through the fourth source board cable.

The seventh connection cable may be configured the same as the first connection cable, the eighth connection cable may be configured the same as the second connection cable, the seventh source board may be configured the same as the first source board, the eighth source board may be configured the same as the second source board, and the fourth source board cable may be configured the same as the first source board cable.

Another exemplary embodiment of the present disclosure provides a display device that includes: a control board on which a timing controller (TCON) and a power management integrated circuit (PMIC) are installed; a first source board on which a driving integrated circuit (IC) is installed; and a first connection cable that connects the control board and the first source board. The control board includes a first sensing line that connects the TCON to the first connection cable, and a third feedback line that connects the first connection cable to the PMIC. The first connection cable includes a second sensing line that connects the first sensing line to the first source board and a second feedback line that connects the third feedback line to the first source board, and the first source board includes a third sensing line connected to the second sensing line and a first feedback line connected to the second feedback line.

Yet another exemplary embodiment of the present disclosure provides a driving method of a display device that includes: outputting a power voltage from a power management integrated circuit (PMIC) to a timing controller (TCON); outputting a sensing signal having a predetermined voltage from the PMIC to a first sensing line in a control board; transmitting the sensing signal to a second sensing line in a connection cable that connects the control board to a source board; receiving the sensing signal by the TCON from a third feedback line in the control board that is connected to the source board through the connection cable; and transmitting a power enable signal from the TCON to the PMIC based on the sensing signal. If the sensing signal is received by the TCON at the predetermined voltage, an on-voltage power enable signal is transmitted to the PMIC.

The method may further include transmitting the sensing signal to a third sensing line in the source board that is connected to the second sensing line; transmitting the sensing signal to a first feedback line in the source board that is connected to the third sensing line; and transmitting the sensing signal to a second feedback line in the connection cable that is connected to the first feedback line.

If the sensing signal received by the TCON is not at the predetermined voltage, an off-voltage power enable signal is transmitted to the PMIC.

According to the exemplary embodiments of the present disclosure, it is possible to prevent a failure due to disconnection and misconnection of a control board and a source board.

DETAILED DESCRIPTION

Figure 1:
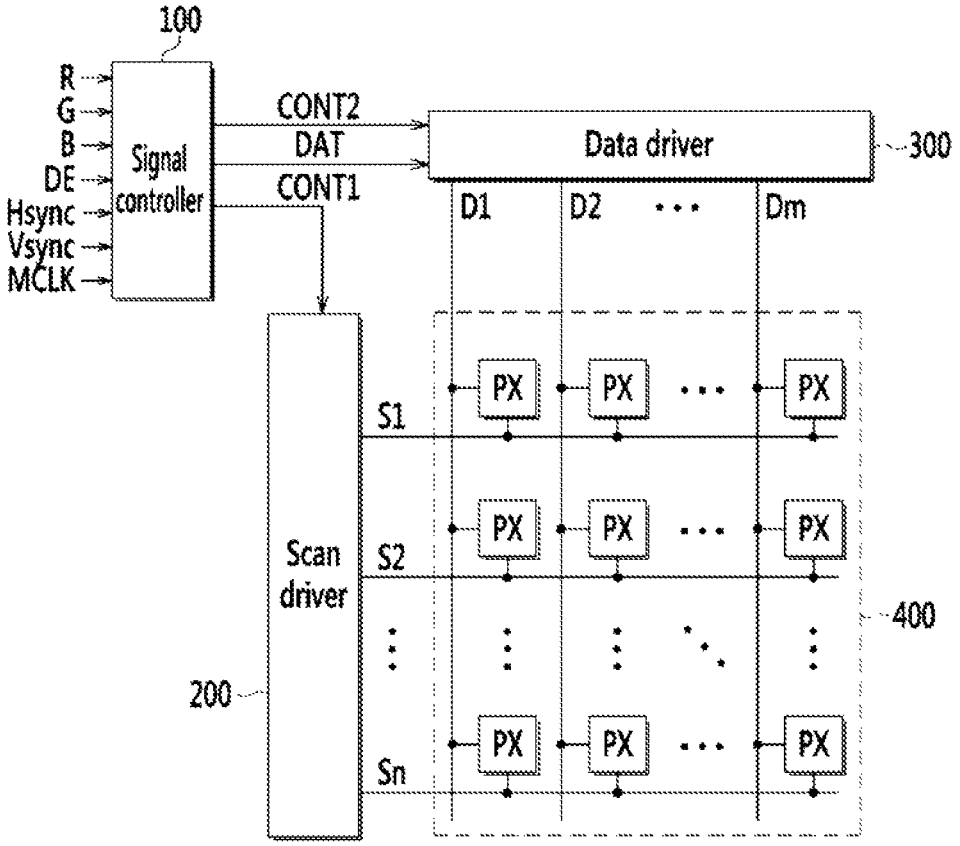
FIG. 1 is a block diagram that illustrates a display device according to an exemplary embodiment of the present disclosure.

Embodiments of the present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

The drawings and description may be regarded as illustrative in nature and not restrictive, and like reference numerals may designate like elements throughout the specification.

FIG. 1 is a block diagram that illustrates a display device according to an exemplary embodiment of the present disclosure.

Referring to FIG. 1, the display device includes a signal controller 100, a scan driver 200, a data driver 300, and a display unit 400.

The display unit 400 includes a plurality of pixels PX arranged substantially in a matrix form, a plurality of scan lines S1 to Sn, and a plurality of data lines D1 to Dm. The plurality of pixels PX is connected to the plurality of scan lines S1 to Sn, and to the plurality of data lines D1 to Dm. The plurality of scan lines S1 to Sn extends substantially in parallel in a row direction, and the plurality of data lines D1 to Dm extends substantially in parallel in a column direction.

The signal controller 100 receives image signals R, G and B from an external device, and a synchronization signal. The image signals R, G, and B include luminance information for the plurality of pixels. The luminance has a predetermined number of levels, for example, 1024($=2^{10}$), 256($=2^{8}$) or 64($=2^{6}$) levels. The synchronization signal includes a data enable signal DE, a horizontal synchronization signal Hsync, a vertical synchronization signal Vsync, and a main clock signal MCLK.

The signal controller 100 generates a first driving control signal CONT1, a second driving control signal CONT2, and image data DAT based on the image signals R, G, and B, the data enable signal DE, the horizontal synchronization signal Hsync, the vertical synchronization signal Vsync, and the main clock signal MCLK. The signal controller 100 divides the image signals R, G, and B into frames based on the vertical synchronization signal Vsync, and divides the image signals R, G, and B into scan linesbased on the horizontal synchronization signal Hsync to generate the image data DAT. The signal controller 100 transmits the first driving control signal CONT1 to the scan driver 200. The signal controller 100 transmits the image data DAT to the data driver 300 together with the second driving control signal CONT2.

The scan driver 200 is connected to the plurality of scan lines S1 to Sn and generates a plurality of scanning signals based on the first driving control signal CONT1. The scan driver 200 may sequentially apply the gate-on voltage scanning signals to the plurality of scan lines S1 to Sn.

The data driver 300 is connected to the plurality of data lines D1 to Dm and samples and holds the input image data DAT based on the second driving control signal CONT2, and transmits the plurality of data signals to the plurality of data lines D1 to Dm. The data signals have a predetermined voltage range. The data driver 300 applies the data signals to the plurality of data lines D1 to Dm in response to the gate-on voltage scanning signals.

Each of the aforementioned driving devices 100, 200, and 300 may be directly installed on the display unit 400 in the form of at least one IC chip, installed on a flexible printed circuit (FPC) film, attached to the display unit 400 in the form of a tape carrier package (TCP), or installed on a separate printed circuit board (PCB). Further, the driving devices 100, 200, and 300 may be integrated in the display unit 400 together with the plurality of scan lines S1 to Sn and the plurality of data lines D1 to Dm.

Hereinafter, a configuration in which the signal controller 100 and the data driver 300 are installed on a control board and a source board will be described.

Figure 2:
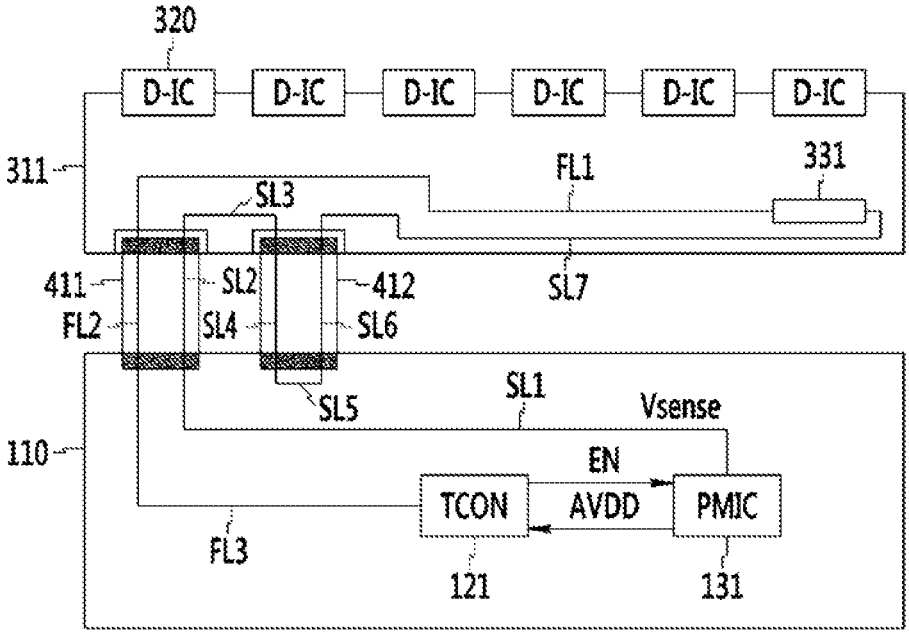
FIG. 2 is a schematic diagram that illustrates a control board and a source board according to an exemplary embodiment of the present disclosure.

FIG. 2 is a schematic diagram that illustrates a control board and a source board according to an exemplary embodiment of the present disclosure.

Referring to FIG. 2, a timing controller (TCON) 121 and a power management integrated circuit (PMIC) 131 are installed on a control board 110. The control board 110 may be a printed circuit board (PCB). The TCON 121 functions as the signal controller 100 described in FIG. 1. The PMIC 131 is a power device that generates a predetermined power voltage and supplies that power voltage to a plurality of driving ICs 320 and the TCON 121. The control board 110 on which the TCON 121 and the PMIC 131 are installed may be a control printed board assembly (PBA).

The plurality of driving ICs 320 and a bead 331 are installed on a source board 311. The source board 311 may be a PCB. The plurality of driving ICs 320 functions as the data driver 300 described in FIG. 1. The bead 331 removes power noise. The source board 311 on which the plurality of driving ICs 320 and the bead 331 are installed may be a source PBA.

The control board 110 and the source board 311 are connected to a first connection cable 411 and a second connection cable 412. The first connection cable 411 and the second connection cable 412 may be provided as a flexible flat cable (FFC).

A connection structure of the control board 110 and the source board 311 will be described. A first sensing line SL1 that connects the PMIC 131 to the first connection cable 411 is disposed in the control board 110. A second sensing line SL2 that connects the first sensing line SL1 to the source board 311 is disposed in the first connection cable 411. A third sensing line SL3 that connected to the second sensing line SL2 is disposed in the source board 311. A fourth sensing line SL4 that connects the third sensing line SL3 to the control board 110 is disposed in the second connection cable 412. A fifth sensing line SL5 connected to the fourth sensing line SL4 is disposed in the control board 110. A sixth sensing line SL6 that connects the fifth sensing line SL5 to the source board 311 is disposed in the second connection cable 412. A seventh sensing line SL7 that connects the sixth sensing line SL6 to the bead 331 is disposed in the source board 311. A first feedback line FL1 that connects the bead 331 to the first connection cable 411 is disposed in the source board 311. The seventh sensing line SL7 and the first feedback line FL1 are connected to each other through the bead 331. A second feedback line FL2 that connects the first feedback line FL1 to the control board 110 is disposed in the first connection cable 411. A third feedback line FL3 that connects the second feedback line FL2 to the TCON 121 is disposed in the control board 110. The sensing line includes first to seventh sensing lines SL1 to SL7. The feedback line includes first to third feedback lines FL1 to FL3.

Here, the two connection cables 411 and 412 are exemplary, but the connection cables are not limited thereto. The control board 110 and the source board 311 may be connected to at least one cable. If the control board 110 and the source board 311 are connected to one connection cable 411, the third sensing line SL3 disposed in the source board 311 may connect the second sensing line SL2 and the bead 331. That is, the third sensing line SL3 may connect the second sensing line SL2 and the first feedback line FL1. This is similar to other exemplary embodiments to be described below.

The TCON 121 receives an AVDD power voltage from the PMIC 131. The TCON 121 transmits a power enable signal EN that controls driving to the PMIC 131. The PMIC 131 outputs a sensing signal Vsense having a predetermined voltage to the first sensing line SL1. A voltage of 3.3V outputted to the scan driver 200 may be used to generate a scanning signal by the AVDD power voltage and the sensing signal Vsense.

Hereinafter, a method of sensing whether the control board 110 and the source board 311 are accurately connected to a first connection cable 411 and a second connection cable 412 will be described.

In an initial stage when the display device is turned on, the PMIC 131 outputs the AVDD power voltage to the TCON 121 and outputs the sensing signal Vsense to the first sensing line SL1. The sensing signal Vsense has a predetermined voltage. The sensing signal Vsense is transmitted to the TCON 121 through the sensing lines SL1 to SL7 and the feedback lines FL1 to FL3. That is, when the sensing signal Vsense is output to the first sensing line SL1, the sensing signal Vsense is transmitted in sequence of the second sensing line SL2, the third sensing line SL3, the fourth sensing line SL4, the fifth sensing line SL5, the sixth sensing line SL6, the seventh sensing line SL7, the first feedback line FL1, the second feedback line FL2, and the third feedback line FL3, and finally transmitted to the TCON 121.

If the control board 110 and the source board 311 are accurately connected to each other, the sensing signal Vsense is received by the TCON 121 at the predetermined voltage. The TCON 121 determines a connection state of the control board 110 and the source board 311 by the signal received from the third feedback line FL3. That is, when the AVDD power voltage and the sensing signal Vsense have the predetermined voltage, the TCON 121 determines that the control board 110 and the source board 311 are accurately connected to each other, and transmits an on voltage power enable signal EN to the PMIC 131. The PMIC 131 starts normal driving based on the on-voltage power enable signal EN and generates a driving voltage to operate the plurality of driving ICs 320, a driving voltage for pixels to emit light, etc.

If the control board 110 and the source board 311 are disconnected or misconnected, there will be portions where the first to seventh sensing lines SL1 to SL7, and the first to third feedback lines FL1 to FL3 are not connected to each other. As a result, the sensing signal Vsense output from the PMIC 131 is not normally transmitted to the TCON 121. If at least one of the sensing signal Vsense and the AVDD power voltage does not have the predetermined voltage, the TCON 121 outputs an off-voltage power enable signal EN. When an off-voltage power enable signal EN is received, the PMIC 131 stops driving.

As such, if the control board 110 and the source board 311 are disconnected or misconnected, the PMIC 131 stops driving to prevent a failure from occurring due to an overload applied to the driving IC 320, the PMIC 131, etc.

Figure 3:
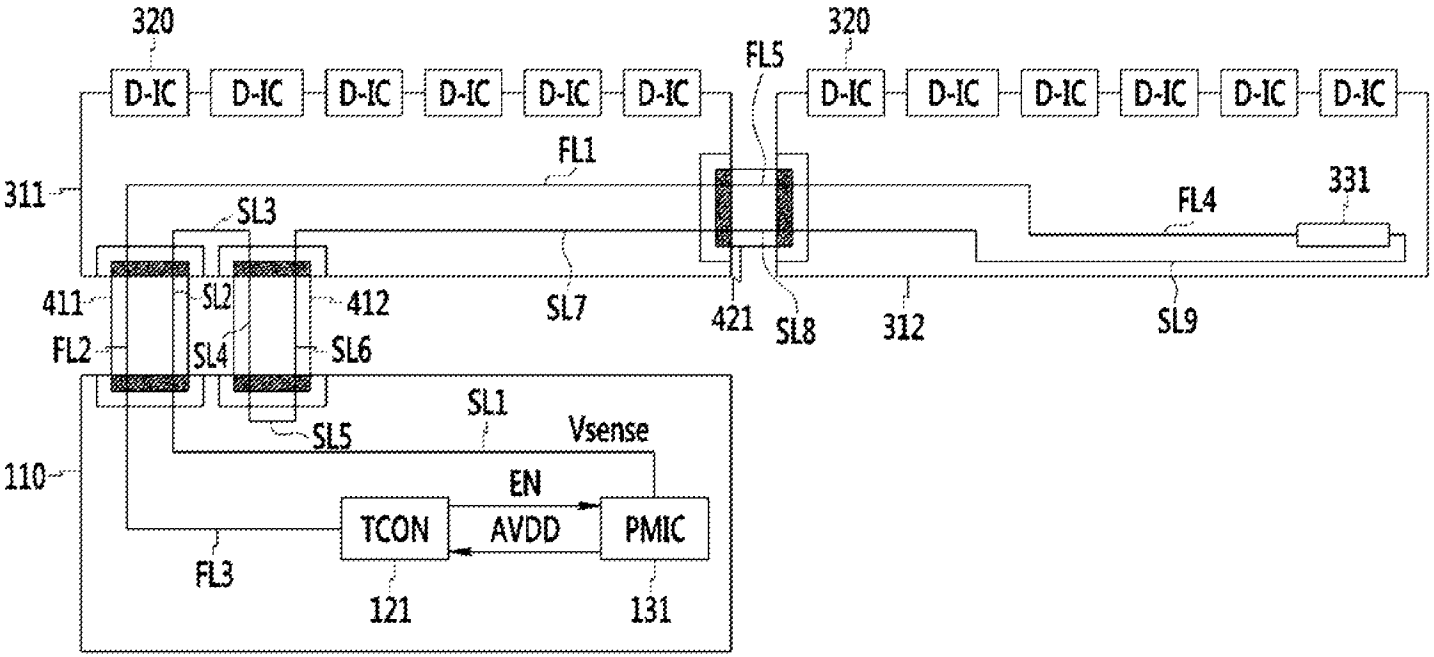
FIG. 3 is a schematic diagram that illustrates a control board and a source board according to another exemplary embodiment of the present disclosure.

FIG. 3 is a schematic diagram that illustrates a control board and a source board according to another exemplary embodiment of the present disclosure.

Referring to FIG. 3, a TCON 121 and a PMIC 131 are installed on a control board 110. The control board 110 may be a PCB. The TCON 121 functions as the signal controller 100 described in FIG. 1. The PMIC 131 is a power device that generates a predetermined power voltage and supplies that power voltage to a plurality of driving ICs 320 and to the TCON 121.

A plurality of driving ICs 320 is installed on a first source board 311 and a second source board 312. A bead 331 is installed on the second source board 312. The first source board 311 and the second source board 312 may be PCBs. The plurality of driving ICs 320 functions as the data driver 300 described in FIG. 1. The bead 331 removes power noise.

The control board 110 and the source board 311 are connected to a first connection cable 411 and a second connection cable 412. The first source board 311 and the second source board 312 are connected to a source board cable 421. The first connection cable 411 and the second connection cable 412 may be a flexible flat cable (FFC). The source board cable 421 may be a flexible printed circuit (FPC).

A connection structure of the control board 110, the first source board 311, and the second source board 312 will be described. A first sensing line SL1 that connects the PMIC 131 to the first connection cable 411 is disposed in the control board 110. A second sensing line SL2 that connects the first sensing line SL1 to the first source board 311 is disposed in the first connection cable 411. A third sensing line SL3 connected to the second sensing line SL2 is disposed in the first source board 311. A fourth sensing line SL4 that connects the third sensing line SL3 to the control board 110 is disposed in the second connection cable 412. A fifth sensing line SL5 connected to the fourth sensing line SL4 is disposed in the control board 110. A sixth sensing line SL6 that connects the fifth sensing line SL5 to the first source board 311 is disposed in the second connection cable 412. A seventh sensing line SL7 connected to the sixth sensing line SL6 is disposed in the first source board 311. An eighth sensing line SL8 that connects the seventh sensing line SL7 to the second source board 312 is disposed in the source board cable 421. A ninth sensing line SL9 that connects the eighth sensing line SL8 to the bead 331 is disposed in the second source board 312. A fourth feedback line FL4 that connects the bead 331 to the source board cable 421 is disposed in the second source board 312. The ninth sensing line SL9 and the fourth feedback line FL4 are connected to each other through the bead 331. A fifth feedback line FL5 connected to the fourth feedback line FL4 is disposed in the source board cable 421. A first feedback line FL1 connected to the fifth feedback line FL5 is disposed in the first source board 311. A second feedback line FL2 that connects the first feedback line FL1 to the control board 110 is disposed in the first connection cable 411. A third feedback line FL3 that connects the second feedback line FL2 to the TCON 121 is disposed in the control board 110. The sensing lines include first to ninth sensing lines SL1 to SL9. The feedback lines include first to fifth feedback lines FL1 to FL5.

The TCON 121 receives an AVDD power voltage from the PMIC 131. The TCON 121 transmits a power enable signal EN that controls driving to the PMIC 131. The PMIC 131 outputs a sensing signal Vsense having a predetermined voltage to the first sensing line SL1.

Hereinafter, a method of sensing whether the control board 110, the first source board 311, and the second source board 312 are accurately connected to the first connection cable 411, the second connection cable 412, and the source board cable 421 will be described.

In an initial stage when the display device is turned on, the PMIC 131 outputs the AVDD power voltage to the TCON 121 and outputs the sensing signal Vsense to the first sensing line SL1. The sensing signal Vsense is transmitted to the TCON 121 through the sensing lines SL1 to SL9 and the feedback lines FL1 to FL5. If the control board 110, the first source board 311, and the second source board 312 are accurately connected, the sensing signal Vsense is received by the TCON 121. When the AVDD power voltage and the sensing signal Vsense have the predetermined voltage, the TCON 121 determines that the control board 110, the first source board 311, and the second source board 312 are accurately connected and transmits an on-voltage power enable signal EN to the PMIC 131. The PMIC 131 starts normal driving based on the on-voltage power enable signal EN and generates a driving voltage to operate the plurality of driving ICs 320, a driving voltage for the pixels to emit light, etc.

If the control board 110, the first source board 311, and the second source board 312 are disconnected or misconnected, there will be portions where the first to ninth sensing lines SL1 to SL9, and the first to fifth feedback lines FL1 to FL5 are not connected to each other. As a result, the sensing signal Vsense output from the PMIC 131 is not normally transmitted to the TCON 121. If at least one of the sensing signal Vsense and the AVDD power voltage does not have the predetermined voltage, the TCON 121 outputs an off-voltage power enable signal EN. When an off-voltage power enable signal EN is received, the PMIC 131 stops driving.

As such, if the control board 110, the first source board 311, and the second source board 312 are disconnected or misconnected, the PMIC 131 stops driving to prevent a failure from occurring due to an overload applied to the driving IC 320, the PMIC 131, etc.

Figure 4:
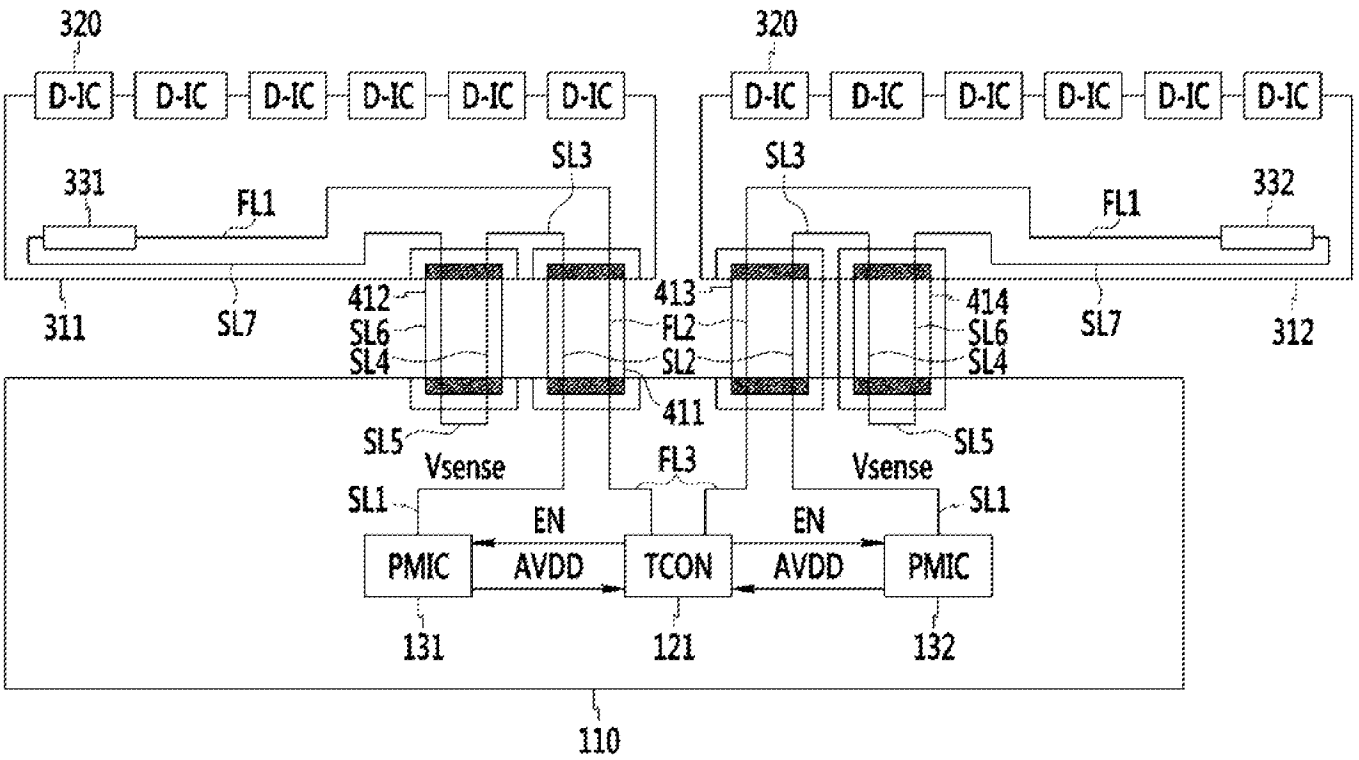
FIG. 4 is a schematic diagram that illustrates a control board and a source board according to yet another exemplary embodiment of the present disclosure.

FIG. 4 is a schematic diagram that illustrates a control board and a source board according to yet another exemplary embodiment of the present disclosure.

Referring to FIG. 4, a TCON 121, a first PMIC 131, and a second PMIC 132 are installed on a control board 110. The control board 110 may be a PCB. The TCON 121 functions as the signal controller 100 described in FIG. 1. The first PMIC 131 and the second PMIC 132 are power devices that generate a predetermined power voltage and supply that power voltage to a plurality of driving ICs 320 and the TCON 121. The control board 110 on which the TCON 121, the first PMIC 131, and the second PMIC 131 are installed may be a control PBA.

The plurality of driving ICs 320 is installed on a first source board 311 and a second source board 312. A first bead 331 is installed on the first source board 311, and a second bead 332 is installed on the second source board 312. The first source board 311 and the second source board 312 may be PCBs. The plurality of driving ICs 320 functions as the data driver 300 described in FIG. 1. The first bead 331 and the second bead 332 remove power noise.

The control board 110 and the first source board 311 are connected to a first connection cable 411 and a second connection cable 412. The control board 110 and the second source board 312 are connected to a third connection cable 413 and a fourth connection cable 414.

The first connection cable 411, the second connection cable 412, the third connection cable 413 and the fourth connection cable 414 may be FFCs.

A connection structure of the control board 110 and the first source board 311 will be described. A first sensing line SL1 that connects the PMIC 131 to the first connection cable 411 is disposed in the control board 110. A second sensing line SL2 that connects the first sensing line SL1 to the first source board 311 is disposed in the first connection cable 411. A third sensing line SL3 connected to the second sensing line SL2 is disposed in the first source board 311. A fourth sensing line SL4 that connects the third sensing line SL3 to the control board 110 is disposed in the second connection cable 412. A fifth sensing line SL5 connected to the fourth sensing line SL4 is disposed in the control board 110. A sixth sensing line SL6 that connects the fifth sensing line SL5 to the source board 311 is disposed in the second connection cable 412. A seventh sensing line SL7 that connects the sixth sensing line SL6 to the first bead 331 is disposed in the first source board 311. A first feedback line FL1 that connects the first bead 331 to the first connection cable 411 is disposed in the first source board 311. The seventh sensing line SL7 and the first feedback line FL1 are connected to each other through the first bead 331. A second feedback line FL2 that connects the first feedback line FL1 to the control board 110 is disposed in the first connection cable 411. A third feedback line FL3 that connects the second feedback line FL2 to and the TCON 121 is disposed in the control board 110.

A connection structure of the control board 110 and the second source board 312 will be described. A first sensing line SL1 that connects the second PMIC 132 to the third connection cable 413 is disposed in the control board 110. A second sensing line SL2 that connects the first sensing line SL1 to the second source board 312 is disposed in the third connection cable 413. A third sensing line SL3 connected to the second sensing line SL2 is disposed in the second source board 312. A fourth sensing line SL4 that connects the third sensing line SL3 and the control board 110 is disposed in the fourth connection cable 414. A fifth sensing line SL5 connected to the fourth sensing line SL4 is disposed in the control board 110. A sixth sensing line SL6 that connects the fifth sensing line SL5 to the second source board 312 is disposed in the fourth connection cable 414. A seventh sensing line SL7 that connects the sixth sensing line SL6 to the second bead 332 is disposed in the second source board 312. A first feedback line FL1 that connects the second bead 332 to the third connection cable 413 is disposed in the second source board 312. The seventh sensing line SL7 and the first feedback line FL1 are connected to each other through the second bead 332. A second feedback line FL2 that connects the first feedback line FL1 to the control board 110 is disposed in the third connection cable 413. A third feedback line FL3 that connects the second feedback line FL2 to the ICON 121 is disposed in the control board 110.

The third connection cable 413 may be configured the same as the first connection cable 411, the fourth connection cable 414 may be configured the same as the second connection cable 412, and the second source board 312 may be configured the same as the first source board 311.

The ICON 121 receives the AVDD power voltage from the first PMIC 131 and the second PMIC 132. The TCON 121 transmits the power enable signal EN that controls driving to the first PMIC 131 and the second PMIC 132. The PMIC 131 outputs a sensing signal Vsense having a predetermined voltage to the first sensing line SL1 connected to the first connection cable 411. The PMIC 132 outputs a sensing signal Vsense having a predetermined voltage to the first sensing line SL1 connected to the third connection cable 413.

Hereinafter, a method of sensing whether the control board 110, the first source board 311, and the second source board 312 are accurately connected to the first connection cable 411, the second connection cable 412, the third connection cable 413, and the fourth connection cable 414 will be described.

In an initial stage when the display device is turned on, the first PMIC 131 outputs the AVDD power voltage to the TCON 121, and outputs the sensing signal Vsense to the first sensing line SL1 connected to the first connection cable 411. In addition, the second PMIC 132 outputs the AVDD power voltage to the TCON 121, and outputs the sensing signal Vsense to the first sensing line SL1 connected to the third connection cable 413. The sensing signal Vsense is transmitted to the TCON 121 through the sensing lines SL1 to SL7 and the feedback lines FL1 to FL3. If the control board 110, the first source board 311, and the second source board 312 are accurately connected, the sensing signal Vsense is received by the TCON 121. When the AVDD power voltage and the sensing signal Vsense are received at the predetermined voltages, the TCON 121 determines that the control board 110, the first source board 311, and the second source board 312 are accurately connected, and transmits an on-voltage power enable signal EN to the first PMIC 131 and the second PMIC 132. The first PMIC 131 and the second PMIC 132 start normal driving based on the on-voltage power enable signal EN, and generate a driving voltage to operate the plurality of driving ICs 320, a driving voltage for the pixels to emit light, etc.

If the control board 110, the first source board 131, and the second source board 312 are disconnected or misconnected, there will be portions where the first to seventh sensing lines SL1 to SL7, and the first to third feedback lines FL1 to FL3 are not connected to each other. As a result, the sensing signals Vsense received from the first PMIC 131 and the second PMIC 132 are not normally transmitted to the TCON 121. If at least one of the sensing signal Vsense and the AVDD power voltage does not have the predetermined voltage, the TCON 121 outputs an off-voltage power enable signal EN. When an off-voltage power enable signal EN is received, the first PMIC 131 and the second PMIC 132 stop driving.

As such, if the control board 110, the first source board 311, and the second source board 312 are disconnected or misconnected, the first PMIC 131 and the second PMIC 132 stop driving to prevent a failure from occurring due to an overload applied to the driving IC 320, the first PMIC 131, the second PMIC 132, etc.

Figure 5:
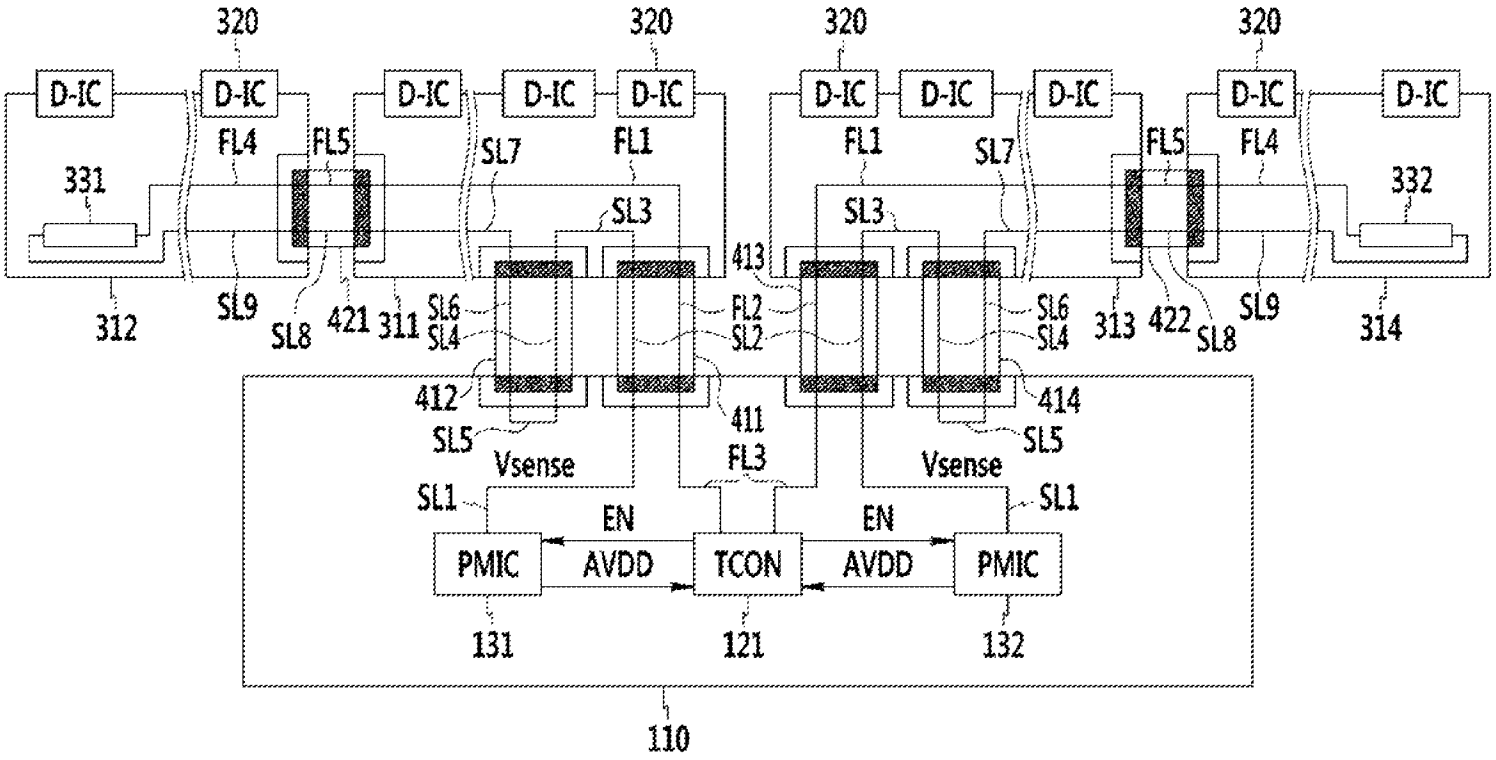
FIG. 5 is a schematic diagram that illustrates a control board and a source board according to yet another exemplary embodiment of the present disclosure.

FIG. 5 is a schematic diagram that illustrates a control board and a source board according to yet another exemplary embodiment of the present disclosure.

Referring to FIG. 5, a TCON 121, a first PMIC 131, and a second PMIC 132 are installed on a control board 110. The control board 110 may be a PCB. The TCON 121 functions as the signal controller 100 described in FIG. 1. The first PMIC 131 and the second PMIC 132 are power devices that generate a predetermined power voltage and supply that power voltage to a plurality of driving ICs 320 and the TCON 121. The control board 110 on which the TCON 121, the first PMIC 131, and the second PMIC 131 are installed may be a control PBA.

The plurality of driving ICs 320 is installed on a first source board 311, a second source board 312, a third source board 313, and a fourth source board 314. A first bead 331 is installed on the second source board 312. A second bead 332 is installed on the fourth source board 314. The first source board 311, the second source board 312, the third source board 313, and the fourth source board 314 may be PCBs. The plurality of driving ICs 320 functions as the data driver 300 described in FIG. 1. The first bead 331 and the second bead 332 remove power noise.

The control board 110 and the first source board 311 are connected to a first connection cable 411 and a second connection cable 412. The first source board 311 and the second source board 312 are connected to a first source board cable 421. The control board 110 and the third source board 313 are connected to a third connection cable 413 and a fourth connection cable 414. The third source board 313 and the fourth source board 314 are connected to a second source board cable 422. The first connection cable 411, the second connection cable 412, the third connection cable 413, and fourth connection cable 414 may be FFCs. The first source board cable 421 and the second source board cable 422 may be FPCs.

A connection structure of the control board 110, the first source board 311, and the second source board 312 will be described. A first sensing line SL1 that connects the first PMIC 131 to the first connection cable 411 is disposed in the control board 110. A second sensing line SL2 that connects the first sensing line SL1 to the first source board 311 is disposed in the first connection cable 411. A third sensing line SL3 connected to the second sensing line SL2 is disposed in the first source board 311. A fourth sensing line SL4 that connects the third sensing line SL3 to the control board 110 is disposed in the second connection cable 412. A fifth sensing line SL5 connected to the fourth sensing line SL4 is disposed in the control board 110. A sixth sensing line SL6 that connects the fifth sensing line SL5 to the source board 311 is disposed in the second connection cable 412. A seventh sensing line SL7 connected to the sixth sensing line SL6 is disposed in the first source board 311. An eighth sensing line SL8 that connects the seventh sensing line SL7 to the second source board 312 is formed in the first source board cable 421. A ninth sensing line SL9 that connects the eighth sensing line SL8 to the first bead 331 is disposed in the second source board 312. A fourth feedback line FL4 that connects the first bead 331 to the first source board cable 421 is disposed in the second source board 312. The ninth sensing line SL9 and the fourth feedback line FL4 are connected to each other through the first bead 331. A fifth feedback line FL5 connected to the fourth feedback line FL4 is disposed in the first source board cable 421. A first feedback line FL1 connected to the fifth feedback line FL5 is disposed in the first source board 311. A second feedback line FL2 that connects the first feedback line FL1 to the control board 110 is disposed in the first connection cable 411. A third feedback line FL3 that connects the second feedback line FL2 to the TCON 121 is disposed in the control board 110.

A connection structure of the control board 110, the third source board 313, and the fourth source board 314 will be described. A first sensing line SL1 that connects the second PMIC 132 to the third connection cable 413 is disposed in the control board 110. A second sensing line SL2 that connects the first sensing line SL1 to the third source board 313 is disposed in the third connection cable 413. A third sensing line SL3 connected to the second sensing line SL2 is disposed in the third source board 313. A fourth sensing line SL4 that connects the third sensing line SL3 to the control board 110 is disposed in the fourth connection cable 414. A fifth sensing line SL5 connected to the fourth sensing line SL4 is disposed in the control board 110. A sixth sensing line SL6 that connects the fifth sensing line SL5 to the second source board 312 is disposed in the fourth connection cable 414. A seventh sensing line SL7 connected to the sixth sensing line SL6 is disposed in the third source board 313. An eighth sensing line SL8 that connects the seventh sensing line SL7 to the fourth source board 314 is disposed in the second source board cable 422. A ninth sensing line SL9 that connects the eighth sensing line SL8 to the second bead 332 is disposed in the fourth source board 314. A fourth feedback line FL4 that connects the second bead 332 to the second source board cable 422 is disposed in the fourth source board 314. The ninth sensing line SL9 and the fourth feedback line FL4 are connected to each other through the second bead 332. A fifth feedback line FL5 connected to the fourth feedback line FL4 is disposed in the second source board cable 422. A first feedback line FL1 connected to the fifth feedback line FL5 is disposed in the third source board 313. A second feedback line FL2 that connects the first feedback line FL1 to the control board 110 is disposed in the third connection cable 413. A third feedback line FL3 that connects the second feedback line FL2 to the TCON 121 is disposed in the control board 110.

The third connection cable 413 may be configured the same as the first connection cable 411, the fourth connection cable 414 may be configured the same as the second connection cable 412, the third source board 313 may be configured the same as the first source board 311, the fourth source board 314 may be configured the same as the second source board 312, and the second source board cable 422 may be configured the same as the first source board cable 421.

The TCON 121 receives the AVDD power voltage from the first PMIC 131 and the second PMIC 132. The TCON 121 transmits the power enable signal EN that controls driving to the first PMIC 131 and the second PMIC 132. The PMIC 131 outputs a sensing signal Vsense having a predetermined voltage to the first sensing line SL1 connected to the first connection cable 411. The PMIC 132 outputs a sensing signal Vsense having a predetermined voltage to the first sensing line SL1 connected to the third connection cable 413.

Hereinafter, a method of sensing whether the control board 110, the first source board 311, the second source board 312, the third source board 313, and the fourth source board 314 are accurately connected to the first connection cable 411, the second connection cable 412, the third connection cable 413, the fourth connection cable 414, the first source board cable 421, and the second source board cable 422 will be described.

In an initial stage when the display device is turned on, the first PMIC 131 outputs the AVDD power voltage to the TCON 121, and outputs the sensing signal Vsense to the first sensing line SL1 connected to the first connection cable 411. In addition, the second PMIC 132 outputs the AVDD power voltage to the TCON 121, and outputs the sensing signal Vsense to the first sensing line SL1 connected to the third connection cable 413. The sensing signal Vsense is transmitted to the TCON 121 through the sensing lines SL1 to SL9 and the feedback lines FL1 to FL5. If the control board 110, the first source board 311, the second source board 312, the third source board 313, and the fourth source board 314 are accurately connected, the sensing signal Vsense is received by the TCON 121. If the AVDD power voltage and the sensing signal Vsense are received at the predetermined voltages, the TCON 121 determines that the control board 110, the first source board 311, the second source board 312, the third source board 313, and the fourth source board 314 are accurately connected and transmits an on-voltage power enable signal EN to the first PMIC 131 and to the second PMIC 132. The first PMIC 131 and the second PMIC 132 start normal driving based on the on-voltage power enable signal EN, and generate a driving voltage to operate the plurality of driving ICs 320, a driving voltage for the pixels to emit light, etc.

If the control board 110, the first source board 311, the second source board 312, the third source board 313, and the fourth source board 314 are disconnected or misconnected, there will be portions where the first to ninth sensing lines SL1 to SL9, and the first to fifth feedback lines FL1 to FL5 are not connected to each other. As a result, the sensing signals Vsense received from the first PMIC 131 and the second PMIC 132 are not normally transmitted to the TCON 121. If at least one of the sensing signal Vsense and the AVDD power voltage does not have the predetermined voltage, the TCON 121 outputs an off-voltage power enable signal EN. When an off-voltage power enable signal EN is received, the first PMIC 131 and the second PMIC 132 stop driving.

As such, if the control board 110, the first source board 311, the second source board 312, the third source board 313, and the fourth source board 314 are disconnected or misconnected, the first PMIC 131 and the second PMIC 132 stop driving to prevent a failure from occurring due to an overload applied to the driving IC 320, the first PMIC 131, the second PMIC 132, etc.

Figure 6:
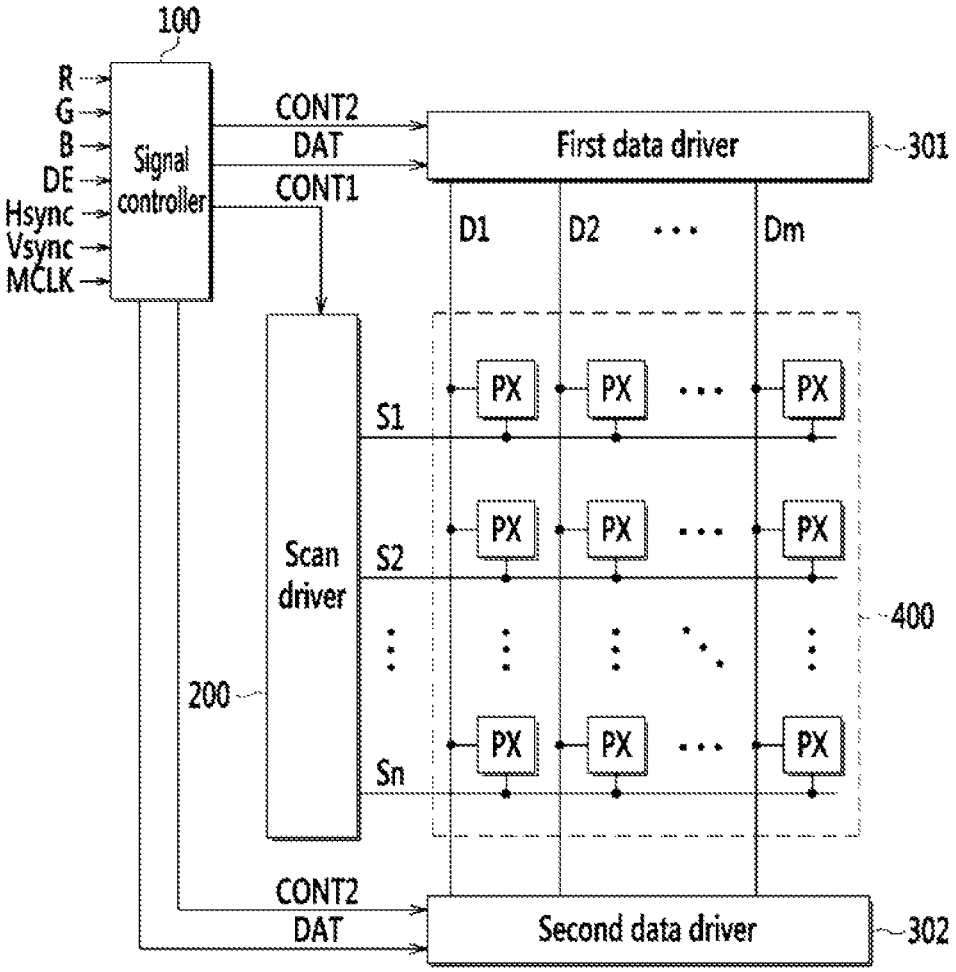
FIG. 6 is a block diagram that illustrates a display device according to another exemplary embodiment of the present disclosure.

FIG. 6 is a block diagram that illustrates a display device according to another exemplary embodiment of the present disclosure.

A display device of FIG. 6 differs from a display device of FIG. 1 in that a data driver of FIG. 6 is provided with a first data driver 301 connected to one side of a plurality of data lines D1 to Dm to apply a data signal and a second data driver 302 connected to the other side of the plurality of data lines D1 to Dm to apply a data signal. The signal controller 100 transmits image data DAT to the first data driver 301 and the second data driver 302 together with a second driving control signal CONT2.

The first data driver 301 and the second data driver 302 operate substantially equally based on the image data DAT and the second driving control signal CONT2. That is, the first data driver 301 and the second data driver 302 apply substantially the same data signals to both sides of the plurality of data lines D1 to Dm.

As such, the first data driver 301 and the second data driver 302 are provided at both sides of the plurality of data lines D1 to Dm, thereby distributing a load of the driving IC in a large display device.

Since other constituent elements are the same as those described in FIG. 1, a detailed description for other elements will be omitted.

Figure 7:
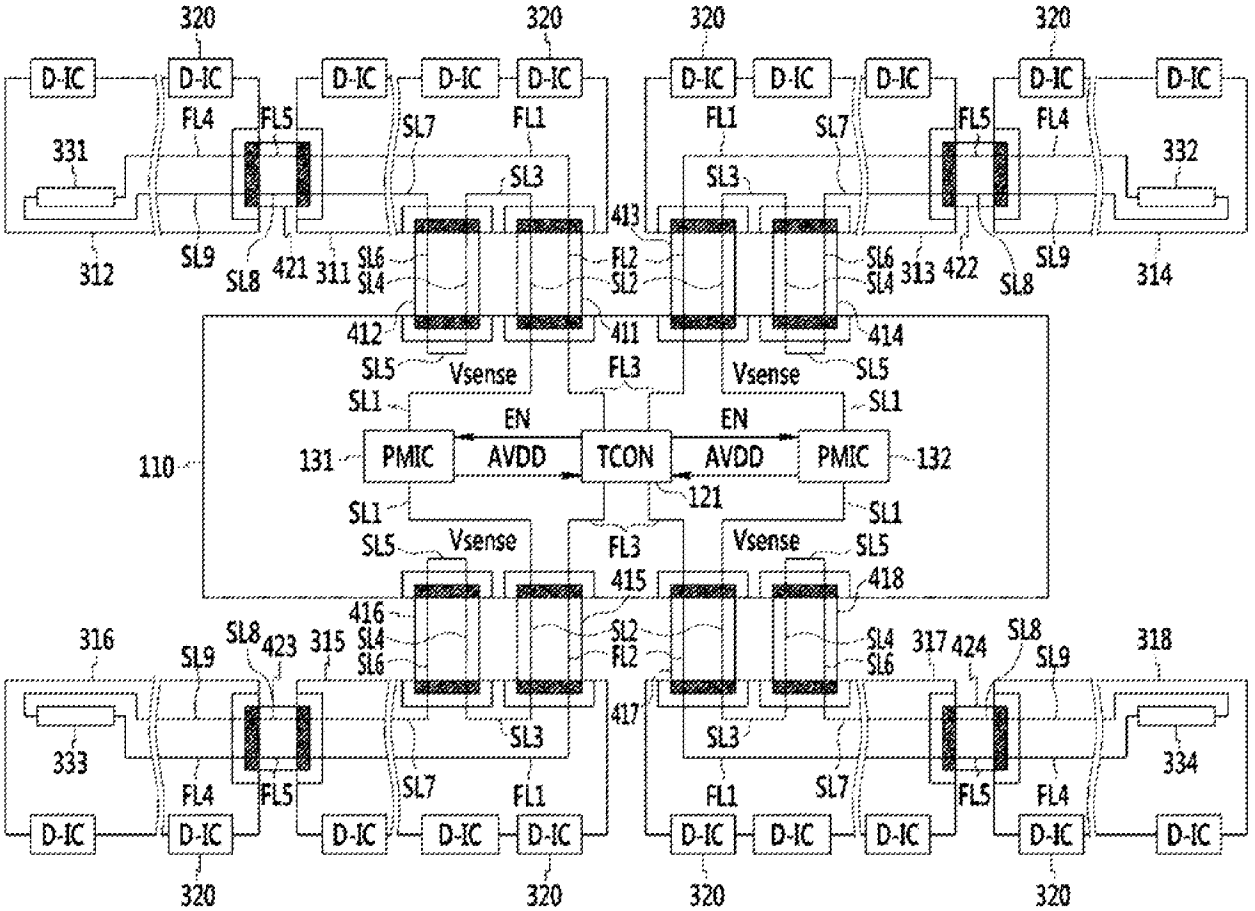
FIG. 7 is a schematic diagram that illustrates a control board and a source board according to yet another exemplary embodiment of the present disclosure.

FIG. 7 is a schematic diagram that illustrates a control board and a source board according to yet another exemplary embodiment of the present disclosure.

Referring to FIG. 7, a TCON 121, a first PMIC 131, and a second PMIC 132 are installed on a control board 110. The control board 110 may be a PCB. The TCON 121 functions as the signal controller 100 described in FIG. 6. The first PMIC 131 and the second PMIC 132 are power devices that generate a predetermined power voltage and supply that power voltage to a plurality of driving ICs 320 and the TCON 121. The control board 110 on which the TCON 121, the first PMIC 131, and the second PMIC 132 are installed may be a control PBA.

The plurality of driving ICs 320 is installed on a first source board 311, a second source board 312, a third source board 313, a fourth source board 314, a fifth source board 315, a sixth source board 316, a seventh source board 317, and an eighth source board 318. A first bead 331 is installed on the second source board 312, a second bead 332 is installed on the fourth source board 314, a third bead 333 is installed on the sixth source board 316, and a fourth bead 334 is installed on the eighth source board 318. The first source board 311, the second source board 312, the third source board 313, the fourth source board 314, the fifth source board 315, the sixth source board 316, the seventh source board 317, and the eighth source board 318 may be PCBs. The plurality of driving ICs 320 functions as the data driver 300 described in FIG. 6. The first bead 331, the second bead 332, the third bead 333, and the fourth bead 334 remove power noise.

The control board 110 and the first source board 311 are connected to a first connection cable 411 and a second connection cable 412. The first source board 311 and the second source board 312 are connected to a first source board cable 421. The control board 110 and the third source board 313 are connected to a third connection cable 413 and a fourth connection cable 414. The third source board 313 and the fourth source board 314 are connected to a second source board cable 422. The control board 110 and the fifth source board 315 are connected to a fifth connection cable 415 and a sixth connection cable 416. The fifth source board 315 and the sixth source board 316 are connected to a third source board cable 423. The control board 110 and the seventh source board 317 are connected to a seventh connection cable 417 and an eighth connection cable 418. The seventh source board 317 and the eighth source board 318 are connected to a fourth source board cable 424.

The first connection cable 411, the second connection cable 412, the third connection cable 413, the fourth connection cable 414, the fifth connection cable 415, the sixth connection cable 416, the seventh connection cable 417, and the eighth connection cable 418 may be FFCs. The first source board cable 421, the second source board cable 422, the third source board cable 423, and the fourth source board cable 424 may be FPCs.

A connection structure of the control board 110, the first source board 311 and the second source board 312 will be described. A first sensing line SL1 that connects the first PMIC 131 to the first connection cable 411 is disposed in the control board 110. A second sensing line SL2 that connects the first sensing line SL1 to the first source board 311 is formed in the first connection cable 411. A third sensing line SL3 connected to the second sensing line SL2 is disposed in the first source board 311. A fourth sensing line SL4 that connects the third sensing line SL3 to the control board 110 is disposed in the second connection cable 412. A fifth sensing line SL5 connected to the fourth sensing line SL4 is disposed in the control board 110. A sixth sensing line SL6 that connects the fifth sensing line SL5 to the source board 311 is disposed in the second connection cable 412. A seventh sensing line SL7 connected to the sixth sensing line SL6 is disposed in the first source board 311. An eighth sensing line SL8 that connects the seventh sensing line SL7 to the second source board 312 is disposed in the first source board cable 421. A ninth sensing line SL9 that connects the eighth sensing line SL8 to the first bead 331 is disposed in the second source board 312. A fourth feedback line FL4 that connects the first bead 331 to the first source board cable 421 is disposed in the second source board 312. The ninth sensing line SL9 and the fourth feedback line FL4 are connected to each other through the first bead 331. A fifth feedback line FL5 connected to the fourth feedback line FL4 is disposed in the first source board cable 421. The first feedback line FL1 connected to the fifth feedback line FL5 is disposed in the first source board 311. A second feedback line FL2 that connects the first feedback line FL1 to the control board 110 is disposed in the first connection cable 411. A third feedback line FL3 that connects the second feedback line FL2 to the TCON 121 is disposed in the control board 110.

A connection structure of the control board 110, the third source board 313 and the fourth source board 314 will be described. A first sensing line SL1 that connects the second PMIC 132 to the third connection cable 413 is disposed in the control board 110. A second sensing line SL2 that connects the first sensing line SL1 to the third source board 313 is disposed in the third connection cable 413. A third sensing line SL3 connected to the second sensing line SL2 is disposed in the third source board 313. A fourth sensing line SL4 that connects the third sensing line SL3 to the control board 110 is formed in the fourth connection cable 414. A fifth sensing line SL5 connected to the fourth sensing line SL4 is disposed in the control board 110. A sixth sensing line SL6 that connects the fifth sensing line SL5 to the third source board 313 is disposed in the fourth connection cable 414. A seventh sensing line SL7 connected to the sixth sensing line SL6 is disposed in the third source board 313. An eighth sensing line SL8 that connects the seventh sensing line SL7 to the fourth source board 314 is disposed in the second source board cable 422. A ninth sensing line SL9 that connects the eighth sensing line SL8 to the second bead 332 is disposed in the fourth source board 314. A fourth feedback line FL4 that connects the second bead 332 to the second source board cable 422 is disposed in the fourth source board 314. The ninth sensing line SL9 and the fourth feedback line FL4 are connected to each other through the second bead 332. A fifth feedback line FL5 connected to the fourth feedback line FL4 is disposed in the second source board cable 422. A first feedback line FL1 connected to the fifth feedback line FL5 is disposed in the third source board 313. A second feedback line FL2 that connects the first feedback line FL1 to the control board 110 is disposed in the third connection cable 413. A third feedback line FL3 that connects the second feedback line FL2 to the TCON 121 is disposed in the control board 110.

A connection structure of the control board 110, the fifth source board 315 and the sixth source board 316 will be described. A first sensing line SL1 that connects the first PMIC 131 to the fifth connection cable 415 is disposed in the control board 110. A second sensing line SL2 that connects the first sensing line SL1 to the fifth source board 315 is disposed in the fifth connection cable 415. A third sensing line SL3 connected to the second sensing line SL2 is disposed in the fifth source board 315. A fourth sensing line SL4 that connects the third sensing line SL3 to the control board 110 is disposed in the sixth connection cable 416. A fifth sensing line SL5 connected to the fourth sensing line SL4 is disposed in the control board 110. A sixth sensing line SL6 that connects the fifth sensing line SL5 to the fifth source board 315 is disposed in the sixth connection cable 416. A seventh sensing line SL7 connected to the sixth sensing line SL6 is disposed in the fifth source board 315. An eighth sensing line SL8 that connects the seventh sensing line SL7 to the sixth source board 316 is disposed in the third source board cable 423. A ninth sensing line SL9 that connects the eighth sensing line SL8 to the third bead 333 is disposed in the sixth source board 316. A fourth feedback line FL4 that connects the third bead 333 to the third source board cable 423 is disposed in the sixth source board 316. The ninth sensing line SL9 and the fourth feedback line FL4 are connected to each other through the third bead 333. A fifth feedback line FL5 connected to the fourth feedback line FL4 is disposed in the third source board cable 423. A first feedback line FL1 connected to the fifth feedback line FL5 is disposed in the fifth source board 315. A second feedback line FL2 that connects the first feedback line FL1 to the control board 110 is disposed in the fifth connection cable 415. A third feedback line FL3 that connects the second feedback line FL2 and the TCON 121 is disposed in the control board 110.

A connection structure of the control board 110, the seventh source board 317 and the eighth source board 318 will be described. A first sensing line SL1 that connects the second PMIC 132 to the seventh connection cable 417 is disposed in the control board 110. A second sensing line SL2 that connects the first sensing line SL1 to the seventh source board 317 is disposed in the seventh connection cable 417. A third sensing line SL3 connected to the second sensing line SL2 is disposed in the seventh source board 317. A fourth sensing line SL4 that connects the third sensing line SL3 to the control board 110 is disposed in the eighth connection cable 418. A fifth sensing line SL5 connected to the fourth sensing line SL4 is disposed in the control board 110. A sixth sensing line SL6 that connects the fifth sensing line SL5 to the seventh source board 317 is disposed in the eighth connection cable 418. A seventh sensing line SL7 connected to the sixth sensing line SL6 is disposed in the seventh source board 317. An eighth sensing line SL8 that connects the seventh sensing line SL7 to the eighth source board 318 is disposed in the fourth source board cable 424. A ninth sensing line SL9 that connects the eighth sensing line SL8 to the fourth bead 334 is disposed in the eighth source board 318. A fourth feedback line FL4 that connects the fourth bead 334 to the fourth source board cable 424 is disposed in the eighth source board 318. The ninth sensing line SL9 and the fourth feedback line FL4 are connected to each other through the fourth bead 334. A fifth feedback line FL5 connected to the fourth feedback line FL4 is disposed in the fourth source board cable 424. A first feedback line FL1 connected to the fifth feedback line FL5 is disposed in the seventh source board 317. A second feedback line FL2 that connects the first feedback line FL1 to the control board 110 is disposed in the seventh connection cable 417. A third feedback line FL3 that connects the second feedback line FL2 to the TCON 121 is disposed in the control board 110.

The fifth connection cable 415 may be configured the same as the first connection cable 411, the sixth connection cable 416 may be configured the same as the second connection cable 412, the fifth source board 315 may be configured the same as the first source board 316, the sixth source board 316 may be configured the same as the second source board 312, and the third source board cable 423 may be configured the same as the first source board cable 421.

The seventh connection cable 417 may be configured the same as the first connection cable 411, the eighth connection cable 418 may be configured the same as the second connection cable 412, the seventh source board 317 may be configured the same as the first source board 311, the eighth source board 318 may be configured the same as the second source board 312, and the fourth source board cable 424 may be configured the same as the first source board cable 421.

The TCON 121 receives the AVDD power voltage from the first PMIC 131 and the second PMIC 132. The TCON 121 transmits the power enable signal EN that controls driving to the first PMIC 131 and the second PMIC 132. The first PMIC 131 outputs a sensing signal Vsense having a predetermined voltage to the first sensing line SL1 connected to the first connection cable 411 and the first sensing line SL1 connected to the fifth connection cable 415. The second PMIC 132 outputs a sensing signal Vsense having a predetermined voltage to the first sensing line SL1 connected to the third connection cable 413 and the first sensing line SL1 connected to the seventh connection cable 417.

Hereinafter, a method of sensing whether the first source board 311, the second source board 312, the third source board 313, the fourth source board 314, the fifth source board 315, the sixth source board 316, the seventh source board 317, and the eighth source board 318 are accurately connected to the first connection cable 411, the second connection cable 412, the third connection cable 413, the fourth connection cable 414, the fifth connection cable 415, the sixth connection cable 416, the seventh connection cable 417, the eighth connection cable 418, the first source board cable 421, the second source board cable 422, the third source board cable 423, and the fourth source board cable 424 will be described.

In an initial stage when the display device is turned on, the first PMIC 131 outputs an AVDD power voltage to the TCON 121, and outputs the sensing signal Vsense to the first sensing line SL1 connected to the first connection cable 411 and the first sensing line SL1 connected to the fifth connection cable 415. In addition, the second PMIC 132 outputs an AVDD power voltage to the TCON 121, and outputs the sensing signal Vsense to the first sensing line SL1 connected to the third connection cable 413 and the first sensing line SL1 connected to the seventh connection cable 417. The sensing signal Vsense is transmitted to the TCON 121 through the sensing lines SL1 to SL9 and the feedback lines FL1 to FL5. When the first to eighth source boards 311 to 318 are accurately connected, the sensing signal Vsense is received by the TCON 121. When the AVDD power voltage and the sensing signal Vsense are received at the predetermined voltage, the TCON 121 determines that the first to eighth source boards to 318 are accurately connected, and transmits an on-voltage power enable signal EN to the first PMIC 131 and to the second PMIC 132. The first PMIC 131 and the second PMIC 132 start normal driving based on the on-voltage power enable signal EN, and generate a driving voltage to operate the plurality of driving ICs 320, a driving voltage for the pixels to emit light, etc.

If any of the first to eighth source boards 311 to 318 are disconnected or misconnected, there will be portions where the first to ninth sensing lines SL1 to SL9, and the first to fifth feedback lines FL1 to FL5 are not connected to each other. As a result, the sensing signals Vsense received from the first PMIC 131 and the second PMIC 132 are not normally transmitted to the TCON 121. When at least one of the sensing signal Vsense and the AVDD power voltage does not have the predetermined voltage, the TCON 121 outputs an off-voltage power enable signal EN. When an off-voltage power enable signal EN is received, the first PMIC 131 and the second PMIC 132 stop driving.

As such, when any of the first to eighth source boards 311 to 318 are disconnected or misconnected, the first PMIC 131 and the second PMIC 132 stop driving to prevent a failure from occurring due to an overload applied to the driving IC 320, the first PMIC 131, the second PMIC 132, etc.

Figure 8:
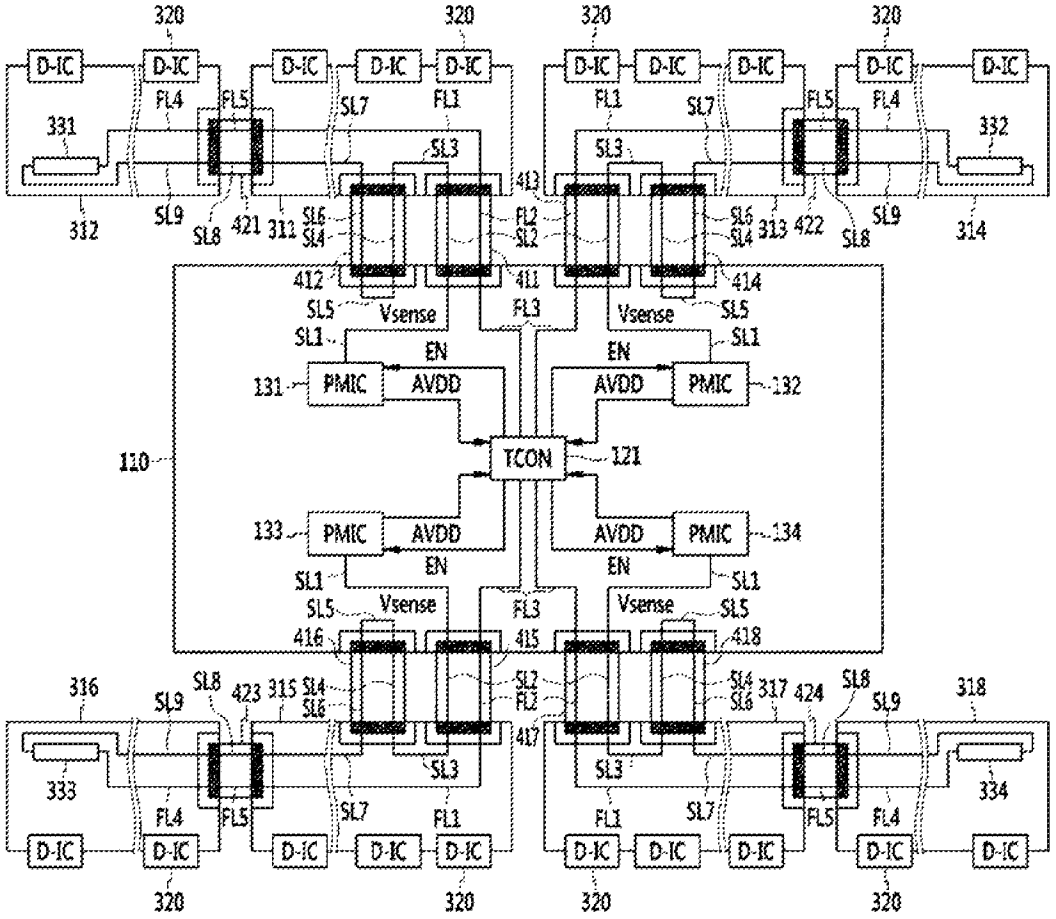
FIG. 8 is a schematic diagram that illustrates a control board and a source board according to yet another exemplary embodiment of the present disclosure.

FIG. 8 is a schematic diagram that illustrates a control board and a source board according to yet another exemplary embodiment of the present disclosure.

Referring to FIG. 8, a TCON 121, a first PMIC 131, a second PMIC 132, a third PMIC 133, and a fourth PMIC 134 are installed on a control board 110. The control board 110 may be a PCB. The TCON 121 functions as the signal controller 100 described in FIG. 6. The first PMIC 131, the second PMIC 132, the third PMIC 133, and the fourth PMIC 134 are power devices that generate a predetermined power voltage and supply that power voltage to a plurality of driving ICs 320 and the TCON 121. The control board 110 on which the TCON 121, the first PMIC 131, the second PMIC 132, the third PMIC 133, and the fourth PMIC 134 are installed may be a control PBA.

Since the first to eighth source boards 311 to 318, the first to eighth connection cables 411 to 418 are substantially the same as those described in FIG. 7, a detailed description thereof will be omitted.

Since a connection structure of the control board 110 and the first and second source boards 311 and 312 is substantially the same as that described in FIG. 7, a detailed description thereof will be omitted. In addition, since a connection structure of the control board 110 and the third and fourth source boards 313 and 314 is substantially the same as that described in FIG. 7, a detailed description thereof will be omitted.

In the connection structure of the control board 110 and the fifth and sixth source boards 315 and 316, a first sensing line SL1 that connects the third PMIC 133 to the fifth connection cable 415 is disposed in the control board 110.

Since other structures are substantially the same as those described in FIG. 7, a detailed description for other structures will be omitted.

In the connection structure of the control board 110 and the seventh and eighth source boards 317 and 318, a first sensing line SL1 that connects the fourth PMIC 134 to the seventh connection cable 417 is disposed in the control board 110. Since other structures are substantially the same as those described in FIG. 7, a detailed description for other structures will be omitted.

The TCON 121 receives an AVDD power voltage from the first PMIC 131, the second PMIC 132, the third PMIC 133, and the fourth PMIC 134. The TCON 121 transmits the power enable signal EN that controls driving to the first to fourth PMICs 131 to 134. The first PMIC 131 outputs a sensing signal Vsense having a predetermined voltage to the first sensing line SL1 connected to the first connection cable 411. The second PMIC 132 outputs a sensing signal Vsense having a predetermined voltage to the first sensing line SL1 connected to the third connection cable 413. The third PMIC 133 outputs a sensing signal Vsense having a predetermined voltage to the first sensing line SL1 connected to the fifth connection cable 415. The fourth PMIC 134 outputs a sensing signal Vsense having a predetermined voltage to the first sensing line SL1 connected to the seventh connection cable 417.

In an initial stage when the display device is turned on, the first PMIC 131 outputs the AVDD power voltage to the TCON 121, and outputs the sensing signal Vsense to the first sensing line SL1 connected to the first connection cable 411. The second PMIC 132 outputs the AVDD power voltage to the TCON 121, and outputs the sensing signal Vsense to the first sensing line SL1 connected to the third connection cable 413. The third PMIC 133 outputs the AVDD power voltage to the TCON 121, and outputs the sensing signal Vsense to the first sensing line SL1 connected to the fifth connection cable 415. The fourth PMIC 134 outputs the AVDD power voltage to the TCON 121, and outputs the sensing signal Vsense to the first sensing line SL1 connected to the seventh connection cable 417.

The sensing signal Vsense is transmitted to the TCON 121 through the sensing lines SL1 to SL9 and the feedback lines FL1 to FL5. If the first to eighth source boards 311 to 318 are accurately connected, the sensing signal Vsense is received by the TCON 121. If the AVDD power voltage and the sensing signal Vsense are received at the predetermined voltage, the TCON 121 determines that the first to eighth source boards 311 to 318 are accurately connected, and transmits an on-voltage power enable signal EN to the first to fourth PMICs 131 to 134. The first to fourth PMICs 131 to 134 start normal driving based on the on-voltage power enable signal EN, and generate a driving voltage to operate the plurality of driving ICs 320, a driving voltage for the pixels to emit light, etc.

If any of the first to eighth source boards 311 to 318 are disconnected or misconnected, there will be portions where the first to ninth sensing lines SL1 to SL9, and the first to fifth feedback lines FL1 to FL5 are not connected to each other. As a result, the sensing signals Vsense received from the first to fourth PMICs 131 to 134 are not normally transmitted to the TCON 121. If at least one of the sensing signal Vsense and the AVDD power voltage does not have the predetermined voltage, the TCON 121 outputs an off-voltage power enable signal EN. When an off-voltage power enable signal EN is received, the first to fourth PMICs 131 to 134 stop driving.

As such, when any of the first to eighth source boards 311 to 318 are disconnected or misconnected, the first to fourth PMICs 131 to 134 stop driving to prevent a failure from occurring due to an overload applied to the driving IC 320, first PMIC 131, the second PMIC 132, the third PMIC 133, the fourth PMIC 134, etc.

Figure 9:
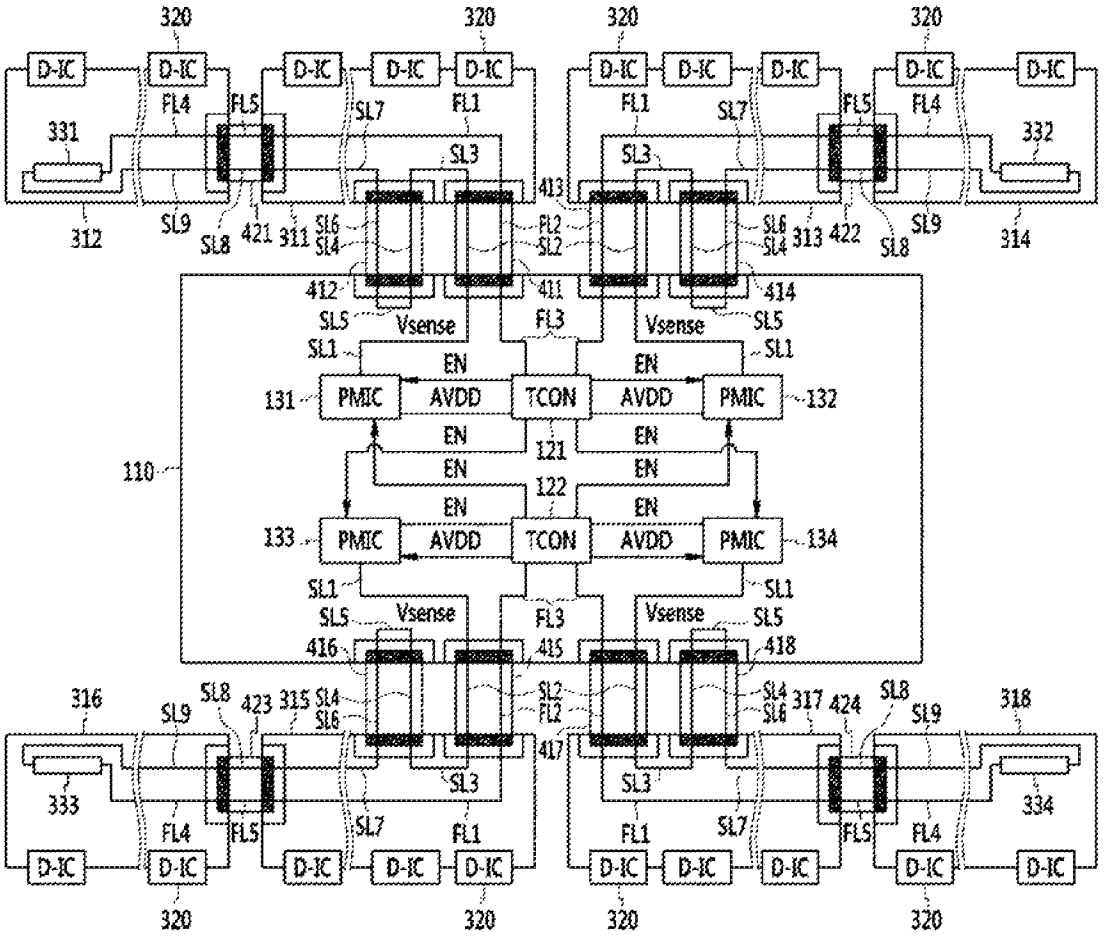
FIG. 9 is a schematic diagram that illustrates a control board and a source board according to yet another exemplary embodiment of the present disclosure.

FIG. 9 is a schematic diagram that illustrates a control board and a source board according to yet another exemplary embodiment of the present disclosure.

Referring to FIG. 9, a first TCON 121, a second TCON 122, a first PMIC 131, a second PMIC 132, a third PMIC 133, and a fourth PMIC 134 are installed on a control board 110. The control board 110 may be a PCB. The first TCON 121 and the second TCON 122 function as the signal controller 100 described in FIG. 6. The first PMIC 131, the second PMIC 132, the third PMIC 133, and the fourth PMIC 134 are power devices that generate a predetermined power voltage and supply that power voltage to a plurality of driving ICs 320 and the first and second TCONs 121 and 122. The control board 110 on which the first TCON 121, the second TCON 122, the first PMIC 131, the second PMIC 132, the third PMIC 133, and the fourth PMIC 134 are installed may be a control PBA.

Since the first to eighth source boards 311 to 318, the first to eighth connection cablse 411 to 418 are substantially the same as those described in FIG. 7, a detailed description thereof will be omitted.

Since a connection structure of the control board 110 and the first and second source boards 311 and 312 is substantially the same as that described in FIG. 7, a detailed description thereof will be omitted. In addition, since a connection structure of the control board 110 and the third and fourth source boards 313 and 314 is substantially the same as that described in FIG. 7, a detailed description thereof will be omitted.

In the connection structure of the control board 110 and the fifth and sixth source boards 315 and 316, a first sensing line SL1 that connects the third PMIC 133 to the fifth connection cable 415 is disposed in the control board 110. Since other structures are the same as those described in FIG. 7, a detailed description for other structures will be omitted.

In the connection structure of the control board 110 and the seventh and eighth source boards 317 and 318, a first sensing line SL1 that connects the fourth PMIC 134 to the seventh connection cable 417 is disposed in the control board 110. Since other structures are the same as those described in FIG. 7, a detailed description for other structures will be omitted.

The first TCON 121 receives the AVDD power voltage from the first and second PMICs 131 and 132. The first TCON 121 generates a power enable signal EN to controlg driving of the first to fourth PMICs 131 to 134. The second TCON 122 receives the AVDD power voltage from the third and fourth PMICs 133 and 134. The second TCON 122 generates a power enable signal EN to control driving of the first to fourth PMICs 131 to 134.

The first PMIC 131 outputs a sensing signal Vsense having a predetermined voltage to the first sensing line SL1 connected to the first connection cable 411. The second PMIC 132 outputs a sensing signal Vsense having a predetermined voltage to the first sensing line SL1 connected to the third connection cable 413. The third PMIC 133 outputs a sensing signal Vsense having a predetermined voltage to the first sensing line SL1 connected to the fifth connection cable 415. The fourth PMIC 134 outputs a sensing signal Vsense having a predetermined voltage to the first sensing line SL1 connected to the seventh connection cable 417.

In an initial stage when the display device is turned on, the first PMIC 131 outputs the AVDD power voltage to the first TCON 121, and outputs the sensing signal Vsense to the first sensing line SL1 connected to the first connection cable 411. The second PMIC 132 outputs the AVDD power voltage to the first TCON 121, and outputs the sensing signal Vsense to the first sensing line SL1 connected to the third connection cable 413. The third PMIC 133 outputs the AVDD power voltage to the second TCON 122, and outputs the sensing signal Vsense to the first sensing line SL1 connected to the fifth connection cable 415. The fourth PMIC 134 outputs the AVDD power voltage to the second TCON 122, and outputs the sensing signal Vsense to the first sensing line SL1 connected to the seventh connection cable 417.

The sensing signal Vsense is transmitted to the TCON 121 through the sensing lines SL1 to SL9 and the feedback lines FL1 to FL5. When the first to eighth source boards 311 to 318 are accurately connected, the sensing signal Vsense is received by the first TCON 121 and the second TCON 122. If the AVDD power voltage and the sensing signal Vsense are received at the predetermined voltage, the first TCON 121 determines that the first to fourth source boards 311 to 314 are accurately connected, and transmits an on-voltage power enable signal EN to the first to fourth PMICs 131 to 134. If the AVDD power voltage and the sensing signal Vsense are received at the predetermined voltage, the second TCON 122 determines that the fifth to eighth source boards 315 to 318 are accurately connected, and transmits an on-voltage power enable signal EN to the first to fourth PMICs 131 to 134. The first to fourth PMICs 131 to 134 start normal driving when on-voltage power enable signals EN are received from the first and second TCONs 121 and 122, and generate a driving voltage to operate the plurality of driving ICs 320, a driving voltage for the pixel to emit light, etc.

If any of the first to eighth source boards 311 to 318 are disconnected or misconnected, there will be portions where the first to ninth sensing lines SL1 to SL9, and the first to fifth feedback lines FL1 to FL5 are not connected to each other. As a result, the sensing signals Vsense output from the first and second PMICs 131 and 132 are not normally transmitted to the first TCON 121, or the sensing signals Vsense received from the third and fourth PMICs 133 and 134 are not normally transmitted to the second TCON 122. If at least one of the sensing signals Vsense and the AVDD power voltages does not have the predetermined voltage, the first and second TCONs 121 and 122 output off-voltage power enable signals EN. If at least one off-voltage power enable signal EN is received from the first or second TCON 121 or 122, the first to fourth PMICs 131 to 134 stop driving.

As such, if any of the first to eight source boards 311 to 318 are disconnected or misconnected, the first to fourth PMICs 131 to 134 stop driving to prevent a failure from occurring due to an overload applied to the driving IC 320, the first to fourth PMICs 131 to 134, etc.

Figure 10:
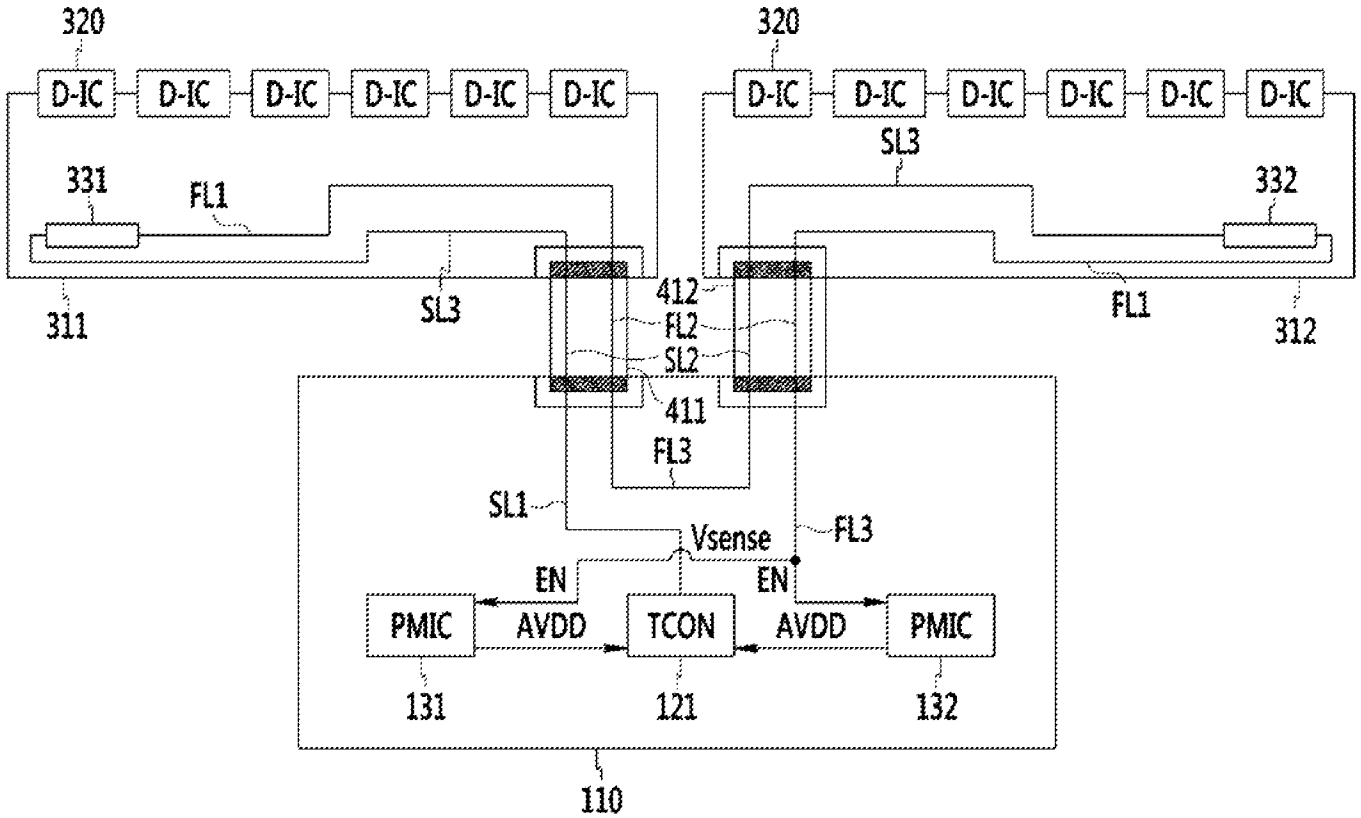
FIG. 10 is a schematic diagram that illustrates a control board and a source board according to yet another exemplary embodiment of the present disclosure.

FIG. 10 is a schematic diagram that illustrates a control board and a source board according to yet another exemplary embodiment of the present disclosure.

Referring to FIG. 10, a ICON 121, a first PMIC 131, and a second PMIC 132 are installed on a control board 110. The control board 110 may be a PCB. The TCON 121 functions as a signal controller 100 described in FIG. 1. The first PMIC 131 and the second PMIC 132 are power devices that generate a predetermined power voltage and supply that power voltage to a plurality of driving ICs 320 and the TCON 121. The control board 110 on which the ICON 121 and the first and second PMICs 131 and 132 are installed may be a control PBA.

The plurality of driving ICs 320 is installed on a first source board 311 and a second source board 312. A first bead 331 is installed on the first source board 311, and a second bead 332 is installed on the second source board 312. The first source board 311 and the second source board 312 may be PCBs. The plurality of driving ICs 320 functions as a data driver 300 described in FIG. 1. The first bead 331 and the second bead 332 remove power noise.

The control board 110 and the first source board 311 are connected to a first connection cable 411. The control board 110 and the second source board 312 are connected to a second connection cable 412.

The first and second connection cables 411 and 412 may be FFCs.

A first sensing line SL1 that connects the first PMIC 131 to the first connection cable 411 is disposed in the control board 110. A second sensing line SL2 that connects the first sensing line SL1 to the first source board 311 is disposed in the first connection cable 411. A third sensing line SL3 that connects the second sensing line SL2 to the first bead 331 is disposed in the first source board 311. A first feedback line FL1 that connects the first bead 331 to the first connection cable 411 is disposed in the first source board 311. The third sensing line SL3 and the first feedback line FL1 are connected to each other through the first bead 331. A second feedback line FL2 that connects the first feedback line FL1 to the control board 110 is disposed in the first connection cable 411. A third feedback line FL3 that connects the second feedback line FL2 to the second connection cable 412 is disposed in the control board 110.

A second sensing line SL2 that connects the third feedback line FL3 to the second source board 312 is disposed in the second connection cable 412. A third sensing line SL3 that connects the second sensing line SL2 to the second bead 332 is disposed in the second source board 312. A first feedback line FL1 that connects the second bead 332 to the second connection cable 412 is disposed in the second source board 312. The third sensing line SL3 and the first feedback line FL1 are connected to each other through the second bead 332. A second feedback line FL2 that connects the first feedback line FL1 to the control board 110 is disposed in the second connection cable 412. A third feedback line FL3 that connects the second feedback line FL2 to the first PMIC 131 and the second PMIC 132 is disposed in the control board 110.

The TCON 121 receives the AVDD power voltage from the first PMIC 131 and the second PMIC 132. The ICON 121 outputs a sensing signal Vsense having a predetermined voltage to the first sensing line SL1 connected to the first connection cable 411. The first PMIC 131 and the second PMIC 132 receive power enable signals EN containing the sensing signals Vsense that are fed-back through the plurality of sensing lines SL1 to SL3 and the plurality of feedback lines FL1 to FL3.

Hereinafter, a method of sensing whether the control board 110 and the first and second source boards 311 and 312 are accurately connected to the first and second connection cables 411 and 412 will be described.

In an initial stage when the display device is turned on, the first PMIC 131 outputs an AVDD power voltage to the TCON 121, and the second PMIC 132 outputs the AVDD power voltage to the ICON 121. The TCON 121 outputs a sensing signal Vsense of a predetermined voltage to the first sensing line SL1 The sensing signals Vsense are transmitted to the first PMIC 131 and the second PMIC 132 as the power enable signal EN through the sensing lines SL1 to SL3 and feedback lines FL1 to FL3, and the sensing lines SL2 and SL3 and the feedback lines FL1 to FL3. If the control board 110 and the first and second source boards 311 and 312 are accurately connected, the sensing signals Vsense are received by the first and second PMICs 131 and 132 at the predetermined voltage, which is an on-voltage power enable signal EN. The first and second PMICs 131 and 132 start normal driving when the sensing signals Vsense are received as an on-voltage power enable signal EN, and generate a driving voltage to operate of the plurality of driving ICs 320, a driving voltage for the pixels to emit light, etc.

If any of the control board 110 and the first and second source boards 131 and 312 are disconnected or misconnected, there will be portions where the sensing lines SL1 to SL3, the feedback lines FL1 to FL3, and the sensing lines SL2 and SL3 and the feedback lines FL1 to FL3 are not connected. As a result, the sensing signal Vsense output from the TCON 121 is not normally received by the first and second PMICs 131 and 132. This means that an off-voltage power enable signal EN is transmitted to the first and second PMICs 131 and 132. When an off-voltage power enable signal EN is received, the first and second PMICs 131 and stop driving.

As such, if any of the control board 110 and the first and source boards 311 and 312 are disconnected or misconnected, the first and second PMICs 131 and 132 stop driving to prevent a failure from occurring due to an overload applied to the driving IC 320, the first and second PMICs 131 and 132, etc.

While this disclosure has been described in connection with what are presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A display device, comprising:

a control board on which a timing controller (TCON) and a power management integrated circuit (PMIC) are installed;

a first source board on which a driving integrated circuit (IC) is installed; and a first connection cable that connects the control board and the first source board, wherein the control board includes a first sensing line that connects the PMIC to the first connection cable and a third feedback line that connects the first connection cable to the TCON, the first connection cable includes a second sensing line that connects the first sensing line to the first source board and a second feedback line that connects the third feedback line to the first source board, and the first source board includes a third sensing line connected to the second sensing line, and a first feedback line connected to the second feedback line, wherein the PMIC outputs a sensing signal to the first sensing line, and the TCON determines a connection state of the control board and the first source board from a signal received from the third feedback line.

2. The display device of claim 1, wherein:

the TCON transmits an on-voltage power enable signal to the PMIC if the signal received from the third feedback line is at a predetermined voltage.

3. The display device of claim 1, wherein:

the TCON transmits an off-voltage power enable signal to the PMIC if the signal received from the third feedback line is not at a predetermined voltage.

4. The display device of claim 3, wherein:

the PMIC stops driving when the off-voltage power enable signal is received.

5. The display device of claim 1, further comprising:

a second connection cable that connects the control board and the first source board and includes a fourth sensing line that connects the third sensing line and the control board, wherein the control board includes a fifth sensing line connected to the fourth sensing line, the second connection cable includes a sixth sensing line that connects the fifth sensing line to the first source board, and the first source board includes a seventh sensing line connected to the sixth sensing line.

6. The display device of claim 5, further comprising:

a bead installed on the first source board that connects the seventh sensing line and the first feedback line.

7. The display device of claim 5, further comprising:

a third connection cable connected to the control board;

a fourth connection cable connected to the control board; and a second source board connected to the control board through the third connection cable and the fourth connection cable.

8. The display device of claim 7, wherein:

the third connection cable is configured the same as the first connection cable, the fourth connection cable is configured the same as the second connection cable, and the second source board is configured the same as the first source board.

9. The display device of claim 5, further comprising:

a first source board cable connected to the first source board; and a second source board connected to the first source board through the first source board cable, wherein the first source board cable includes an eighth sensing line that connects the seventh sensing line to the second source board, the second source board includes a ninth sensing line connected to the eighth sensing line and a fourth feedback line connected to the ninth sensing line, and the first source board cable includes a fifth feedback line that connects the fourth feedback line to the first feedback line.

10. The display device of claim 9, further comprising:

a third connection cable connected to the control board;

a fourth connection cable connected to the control board;

a third source board connected to the control board through the third connection cable and the fourth connection cable;

a second source board cable connected to the third source board; and a fourth source board connected to the third source board through the second source board cable.

11. The display device of claim 10, wherein:

the third connection cable is configured the same as the first connection cable, the fourth connection cable is configured the same as the second connection cable, the third source board is configured the same as the first source board, the fourth source board is configured the same as the second source board, and the second source board cable is configured the same as the first source board cable.

12. The display device of claim 10, further comprising:

a fifth connection cable connected to the control board;

a sixth connection cable connected to the control board;

a fifth source board connected to the control board through the fifth connection cable and the sixth connection cable;

a third source board cable connected to the fifth source board; and a sixth source board connected to the fifth source board through the third source board cable.

13. The display device of claim 12, wherein:

the fifth connection cable is configured the same as the first connection cable, the sixth connection cable is configured the same as the second connection cable, the fifth source board is configured the same as the first source board, the sixth source board is configured the same as the second source board, and the third source board cable is configured the same as the first source board cable.

14. The display device of claim 12, further comprising:

a seventh connection cable connected to the control board;

an eighth connection cable connected to the control board;

a seventh source board connected to the control board through the seventh connection cable and the eighth connection cable;

a fourth source board cable connected to the seventh source board; and an eighth source board connected to the seventh source board through the fourth source board cable.

15. The display device of claim 14, wherein:

the seventh connection cable is configured the same as the first connection cable, the eighth connection cable is configured the same as the second connection cable, the seventh source board is configured the same as the first source board, the eighth source board is configured the same as the second source board, and the fourth source board cable is configured the same as the first source board cable.

16. A display device, comprising:

a control board on which a timing controller (TCON) and a power management integrated circuit (PMIC) are installed;

a first source board on which a driving integrated circuit (IC) is installed; and a first connection cable that connects the control board and the first source board, wherein the control board includes a first sensing line that connects the TCON to the first connection cable and a third feedback line that connects the first connection cable to the PMIC, the first connection cable includes a second sensing line that connects the first sensing line to the first source board and a second feedback line that connects the third feedback line to the first source board, and the first source board includes a third sensing line connected to the second sensing line, and a first feedback line connected to the second feedback line, wherein the TCON outputs a sensing signal to the first sensing line, and the PMIC determines a connection state of the control board and the first source board from a signal received from the third feedback line.

17. A driving method of a display device, comprising:

outputting a power voltage from a power management integrated circuit (PMIC) to a timing controller (TCON);

outputting a sensing signal having a predetermined voltage from the PMIC to a first sensing line in a control board;

transmitting the sensing signal to a second sensing line in a connection cable that connects the control board to a source board;

receiving the sensing signal by the TCON from a third feedback line in the control board that is connected to the source board through the connection cable; and transmitting a power enable signal from the TCON to the PMIC based on the sensing signal, wherein if the sensing signal is received by the TCON at the predetermined voltage, an on-voltage power enable signal is transmitted to the PMIC.

18. The driving method of a display device of claim 17, further comprising:

transmitting the sensing signal to a third sensing line in the source board that is connected to the second sensing line;

transmitting the sensing signal to a first feedback line in the source board that is connected to the third sensing line; and transmitting the sensing signal to a second feedback line in the connection cable that is connected to the first feedback line.

19. The driving method of a display device of claim 17, wherein if the sensing signal received by the TCON is not at the predetermined voltage, an off-voltage power enable signal is transmitted to the PMIC.

* * * * *